United States Patent [19]

Linecker

[11] 4,351,543

[45] Sep. 28, 1982

[54] DEVICE FOR PUSHING A FORWARDLY EXTENDING PORTION OF A SKI SHOE SOLE INTO A CROSS-COUNTRY SKI BINDING

[76] Inventor: Josef Linecker, Rosengasse 5, A-5230 Mattinghofen, Austria

[21] Appl. No.: 129,638

[22] Filed: Mar. 12, 1980

[30] Foreign Application Priority Data

Mar. 15, 1979 [AT] Austria ..... 1950/79

[51] Int. Cl.[3] ..... A63C 9/00

[52] U.S. Cl. ..... 280/615; 280/607

[58] Field of Search ..... 280/636, 615, 617, 611, 280/607

[56] References Cited

U.S. PATENT DOCUMENTS

| | | | |
|---|---|---|---|
| 2,237,998 | 4/1941 | Nuehauser | 280/636 |
| 3,603,606 | 9/1971 | Eie | 280/615 |
| 4,135,736 | 1/1979 | Druss | 280/636 |
| 4,234,208 | 11/1980 | Anderie | 280/614 |
| 4,235,452 | 11/1980 | Linecker | 280/615 |

FOREIGN PATENT DOCUMENTS

| | | | |
|---|---|---|---|
| 2815167 | 10/1978 | Fed. Rep. of Germany | 280/615 |
| 340170 | 9/1959 | Switzerland | 280/636 |

*Primary Examiner*—Joseph F. Peters, Jr.
*Assistant Examiner*—Milton L. Smith
*Attorney, Agent, or Firm*—Kurt Kelman

[57] ABSTRACT

A device for pushing a forwardly extending portion of a ski shoe sole into a cross-country ski binding mounted on a ski surface closer to the point of the ski than the device and having a sliding surface obliquely descending towards the surface of the ski in the direction of the point of the ski. The sliding surface extends over a length of the ski surface corresponding to the length of the path required for the forwardly extending ski shoe sole portion to be pushed into the binding for engagement therewith. The sliding surface is adapted for gliding engagement with a corresponding surface of the shoe sole whereby the gliding engagement of the surfaces pushes the shoe forwardly into the binding.

4 Claims, 3 Drawing Figures

DEVICE FOR PUSHING A FORWARDLY EXTENDING PORTION OF A SKI SHOE SOLE INTO A CROSS-COUNTRY SKI BINDING

The present invention relates to a device mounted on the surface of a ski for pushing a forwardly extending portion of a ski shoe sole into a cross-country binding mounted on the ski surface closer to the point of the ski than the device. While not limited thereto, the device is particularly useful in combination with the ski binding disclosed and claimed in my copending U.S. Pat. No. 4,235,452, issued Nov. 25, 1980, (which comprises a stirrup into which the forwardly extending sole portion snaps by elastic engagement therewith. The disclosure of this patent with respect to the binding and cooperating shoe portion is incorporated herein by way of reference.)

It is the primary object of this invention to provide a device of the indicated type for automatically attaching a cross-country ski to the shoe of a skier, i.e. to enable the skier to attach the ski simply by stepping into the binding and without use of his hands.

The above and other objects are accomplished according to the invention with an element having a sliding surface obliquely descending towards the surface of the ski in the direction of the point of the ski. The sliding surface extends over a length of the ski surface corresponding to the length of the path required for the forwardly extending ski shoe sole portion to be pushed into the binding for engagement therewith. The sliding surface is adapted for gliding engagement with a corresponding surface of the shoe sole whereby the gliding engagement of the surfaces pushes the shoe forwardly into the binding, for instance into snapping engagement with its stirrup.

The above object, advantages and features of the invention will become more apparent from the following description of certain now preferred embodiments thereof, taken in conjunction with the accompanying schematic drawing wherein FIG. 1 is a top plan view showing an embodiment of the present invention;

Figure 3:
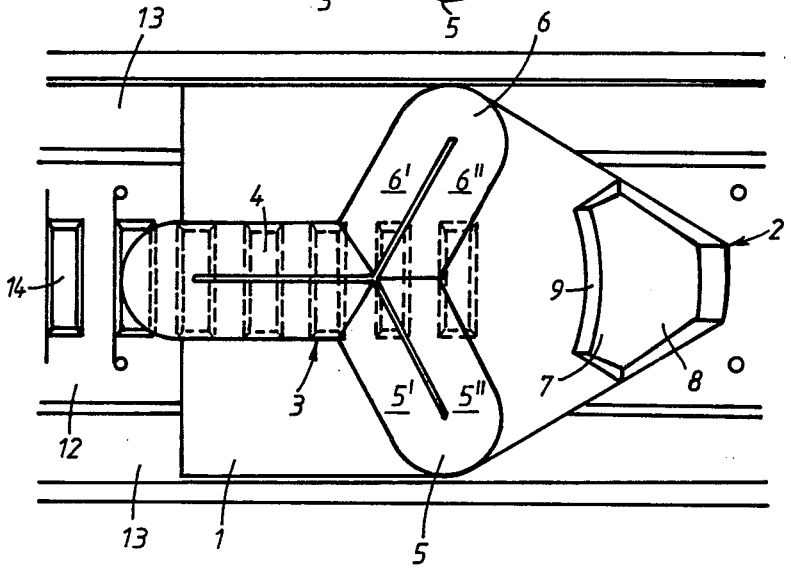
FIG. 3 is a top plan view showing the device of FIGS. 1 and 2 in combination with a longitudinal adjusting means.

Referring now to the drawing, the device is illustrated as comprising carrier plate 1 for an element having a sliding surface. In the illustrated embodiment, this includes a first element 2 and a second guide element 3 each having a sliding surface obliquely descending towards the surface of the ski on which carrier plate 1 is mounted. The carrier plate is shown to be integral with elements 2 and 3, which has the advantage of enabling the device to be manufactured in one piece. While it is possible to affix carrier plate 1 to the ski surface, for instance with screws, FIG. 3 shows an adjustable mounting for the carrier plate on the ski surface.

Figure 2:
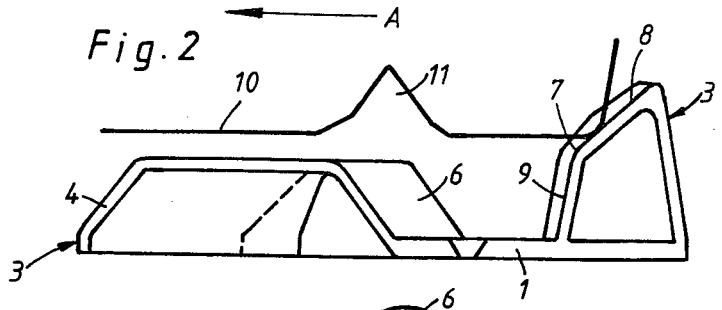
FIG. 2 is a longitudinal section along line II—II of FIG. 1.
Figure 1:
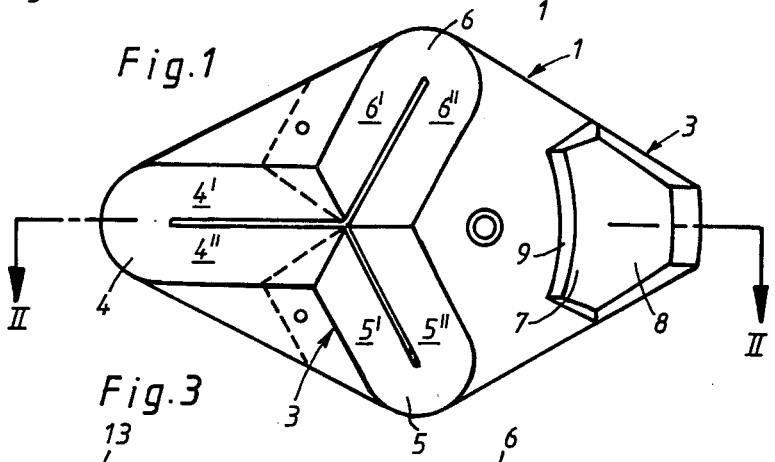

Since the binding and the cooperating shoe portion form no part of this invention, they have not been shown herein. These structures may take any conventional form, for example that disclosed in my copending patent, the ski shoe being diagrammatically represented herein merely by the heel portion of shoe sole 10 opposite the forwardly extending portion of the ski shoe sole (not shown). As shown in FIG. 2, the heel portion has a rear rim and element 2 has a sliding surface 7 obliquely descending towards the surface of the ski in the direction of the point of the ski (not shown) and indicated by arrow A. As best shown in FIG. 1, sliding surface 7 is transversely concave to be adapted for gliding engagement with the convexly curved rear rim of the heel portion, which forms a corresponding surface of the shoe sole, element 2 being so arranged on the ski surface as to make this gliding engagement possible. As illustrated, sliding surface 7 is composed of first sloping section 8 and more steeply sloping section 9 descending towards the ski surface.

In use, the skier steps into the binding by first inserting the forwardly extending shoe sole portion in a retaining component of the binding, for instance a stirrup, and then pressing the heel portion down. In response to the downward pressure, the rear rim of the heel portion will glidingly descend along surface 7, thus forcing the shoe forwardly until the forwardly extending shoe sole portion is firmly engaged in the binding, for example by snapping engagement with the stirrup. The sliding surface extends over a length of the ski surface corresponding to the length of the path required for the forwardly extending ski shoe sole portion to be pushed into the binding for engagement therewith so as to produce the required forward movement. The slope of the sliding surface and its length are so proportioned as to produce this forward movement.

Illustrated guide element 3 is comprised of three radial guide arms 4, 5 and 6 of V-shaped cross section. The guide arms are spaced apart by 120° and two of the guide arms 5, 6 extend transversely to the ski while guide arm 4 extends along the longitudinal center line of the ski. Guide element 3 is only provided as a guide for the shoe sole 10 firmly engaged in the binding (not shown) to control the ski in a transverse direction. Each of the forward surfaces 5', 6' of transversely extending guide arms 5, 6 of V-shaped cross section projected perpendicularly with respect to the surface of the ski (not shown) is smaller than the projected surface 8 of the element 2, measured in the longitudinal direction of the ski, and smaller than the distance to be passed over by the shoe sole relative to the ski to come into firm engagement with the binding, for instance by snapping engagement with the stirrup. Since the guide arms and the recess are V-shaped, the guide arms also have rear inclined surfaces 5'', 6'' glidingly cooperating with corresponding surfaces of recess 11 between shoe sole 10 and the heel portion. A similarly V-shaped forward extension of recess 11 glidingly cooperates with sloping surfaces 4', 4'' of guide arm 4 so that the shoe sole is guided in the direction of the ski elongation during its forward movement. If desired, the element 3 may have substituted therefor a simple, preferably conical, pin coming into engagement with a corresponding bore in the heel portion of the shoe sole so that said shoe sole is firmly engaged in the binding.

Also, if desired, instead of arranging the guide element of the device in the range of the heel portion, it may be mounted, for example, in the range of the arch portion of the shoe sole.

As shown in FIG. 3, the device may comprise means for longitudinally repositioning the element of the device on the ski surface to displace the sliding surface in relation to the point of the ski whereby the device may be adapted to various shoe sizes. The illustrated repositioning means includes guide plate 12 affixed to the ski surface and guidingly receiving carrier plate 1 of the device in grooves 13. Means is provided for selectively holding carrier plate 1 in guide plate 12 in a series of selected positions, the holding means including an axially aligned series of recesses 14 in the guide plate, each recess being adapted to be engaged by a suitable catch (not shown) on the carrier plate. In this manner, the device may be set in different positions at a spacing from the binding corresponding to the size of the shoe.

Obviously, the kinetic relationship of the gliding engagement of the respective shoe sole and device surfaces may be reversed while providing the same forward push of the shoe into the binding. In this case, the element of the device may be a rectangularly shaped block mounted on the ski surface and the heel portion of the ski shoe sole may have a sliding surface extending obliquely rearwardly and upwardly to about the rearmost generatrix of the heel portion and said sliding surface has a generatrix extending substantially transversely to the longitudinal axis of the shoe.

What is claimed is:

1. In combination with a cross-country ski binding mounted on a ski surface and arranged to receive a forwardly extending portion of a ski shoe sole comprising a heel portion opposite the forwardly extending portion: a device mounted on the ski surface for pushing the forwardly extending ski shoe sole portion into the binding, the binding being mounted on the ski surface closer to the point of the ski than the device and the device comprising an element having a sliding surface obliquely descending towards the ski surface in the direction of the ski point, the projected length of the sliding surface on the ski surface corresponding to the length of the path required for the forwardly extending ski show sole portion to be pushed into the binding for engagement therewith, and the sliding surface being adapted for gliding engagement with a corresponding surface of the shoe sole whereby the gliding engagement of the sliding and shoe sole surfaces pushes the shoe forwardly into the binding, the heel portion having a rear rim forming the corresponding shoe sole surface, and the element being arranged on the ski surface for gliding engagement of the rear rim with the sliding surface.

2. The device of claim 1, wherein the sliding surface is composed of a first sloping section and a more steeply sloping section descending towards the ski surface.

3. The device of claim 1, further comprising means for longitudinally repositioning the element on the ski surface to displace the sliding surface in relation to the point of the ski.

4. The device of claim 3, further comprising a carrier plate for the element, the repositioning means including a guide plate affixed to the ski surface and guidingly receiving the carrier plate, and means for selectively holding the carrier plate in the guide plate in a series of selected positions.

* * * * *